United States Patent [19]

Paradis

[11] Patent Number: 4,909,754

[45] Date of Patent: Mar. 20, 1990

[54] CONNECTORS FOR TELECOMMUNICATIONS LINES

[75] Inventor: Roger L. Paradis, Boucherville, Canada

[73] Assignee: Northern Telecom Limited, Montreal, Canada

[21] Appl. No.: 275,817

[22] Filed: Nov. 25, 1988

[51] Int. Cl.[4] ..... H01R 4/24

[52] U.S. Cl. ..... 439/405; 439/395; 439/751

[58] Field of Search ..... 439/389–405, 439/55, 67, 74, 75, 76, 77, 629, 741, 744, 745, 751, 44–47, 65

[56] References Cited

U.S. PATENT DOCUMENTS 3,223,960 12/1965 Ruehlemann ..... 439/751
4,106,837 8/1978 Paluch ..... 439/403
4,545,634 10/1985 Saijo ..... 439/83
4,564,254 1/1986 van Alst ..... 439/404
4,753,609 6/1988 Pfeffer et al. ..... 439/741

*Primary Examiner*—David Pirlot
*Attorney, Agent, or Firm*—R. J. Austin

[57] ABSTRACT

An insulation displacement connector with a dielectric body having terminal members extending through the body, the terminal members having insulation displacement terminals at one end and outwardly projecting terminal pins at the other end. In preferred structures, the terminal pins are displaced from the terminal members so that they lie in two rows which are spaced-apart laterally of a plane of the body. The body may be a single molded structure with location positions for the terminal members inserted into one side of the body.

7 Claims, 3 Drawing Sheets

CONNECTORS FOR TELECOMMUNICATIONS LINES

This invention relates to connectors for tele-communications lines.

Conventionally, modular telecommunications jacks are used to connect telecommunications end user equipment of a customer to his internal wiring network.

Recently, telecommunications outlets are being used in which a housing carries a modular jack and a connector. This development is intended to provide the modular jack with plural functions, in that it may, for instance, be connected alternatively to a telephone or to a data processing terminal which are connectable through the jack to different parts of the network. The modular jack and the connector are connected together in series by insulated wiring. The connections between the modular jack and connector are performed manually in a factory environment so that, when the outlet is on-site, it is merely necessary to connect the connector to the customer's internal wiring network. However, the space for wiring is small and this makes the wiring steps in the factory a tedious exercise.

The present invention provides an insulation displacement connector which in use, seeks to overcome or alleviate the above problems.

Accordingly, the present invention provides an insulation displacement connector comprising a dielectric body having insulation displacement terminal positions at one surface of the body, a plurality of terminal members extending through the body, the terminal members each having one end providing an insulation displacement terminal disposed at an insulation displacement terminal position of the body, and another end from which extends a terminal pin which projects from another surface of the body, the terminal pins being substantially parallel.

This construction of insulation displacement connector according to the invention makes the connector particularly suitable for forming an assembly with a circuit member comprising a base carrying electrical pathways. Such a circuit member may be a printed circuit board or a resistor network which comprises a ceramic base with electrical pathways added by thick film techniques.

According to a further aspect of the present invention, there is provided an assembly of insulation displacement connector and circuit member as defined above, the connector comprising a dielectric body having insulation displacement terminal positions at one surface of the body, a plurality of terminal members extending through the body, the terminal members each having one end providing an insulation displacement terminal disposed at an insulation displacement terminal position of the body, and another end from which extends a terminal pin which projects from another surface of the body, the terminal pins being substantially parallel, and wherein the circuit member comprises a support element and electrical pathways carried by the support element, and in intimate contact therewith, the support element formed with pin receiving holes with the connector mounted upon the circuit member and with the terminal pins received within the holes, the electrical pathways extending to surfaces of the holes and making electrical contact with the terminal pins.

In the above connector or assembly according to the invention, it is preferable that each terminal member has a main portion which is substantially planar and the terminal pin lies in a plane displaced laterally from the plane of the main portion with the terminal members mounted in two staggered rows in the body and with the terminal pins of each row displaced laterally of the plane of the body away from the other row. This particular structure allows a side of the body having the insulation displacement positions to be made relatively narrow, with these positions lying side-by-side in series, while providing wide spacing between the terminal pins to prevent congestion of the circuit pathways in the support member.

Further, in a preferred arrangement, each terminal member has at least one shoulder which engages an abutment within the body to locate the terminal member in a desired position and a retaining means is provided to urge the shoulder against the abutment. This retaining means advantageously comprises at least one projection inclined relative to the main portion and extending away from the insulation displacement terminal to a free end of the projection to allow for insertion of the terminal member into the body from the other surface of the body, the free end of the projection then being embedded into the material of the body to prevent removal of the terminal member from within the body.

When considered in the plane of the main portion, it is convenient to provide a shoulder at each side of the main portion and in the plane thereof, and the retaining means comprises two projections, one at each side of the main portion with each projection corresponding to one of the shoulders.

Embodiments of the invention will now be described, by way of example, with reference to the accompanying drawings, in which.

Figure 1:
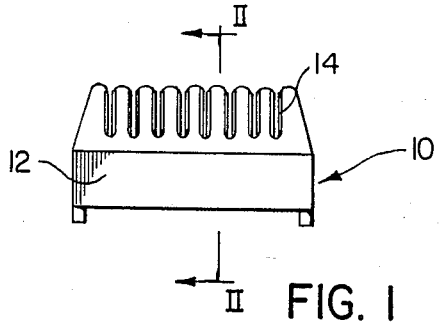
FIG. 1 is a plan view of a connector according to a first embodiment.

As shown in FIG. 1, an insulation displacement connector 10 comprises a molded planar dielectric body 12 having along one side edge, a plurality of molded slots 14 which coincide with insulation displacement terminals of the connector.

Figure 2:
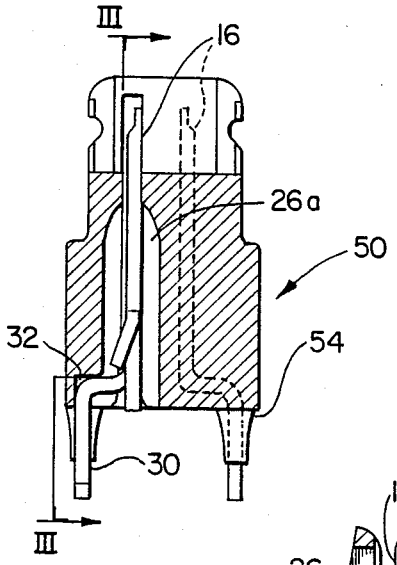
FIG. 2 is cross-sectional view through part of the connector taken along line II—II of FIG. 1 and to a larger scale.
Figure 3:
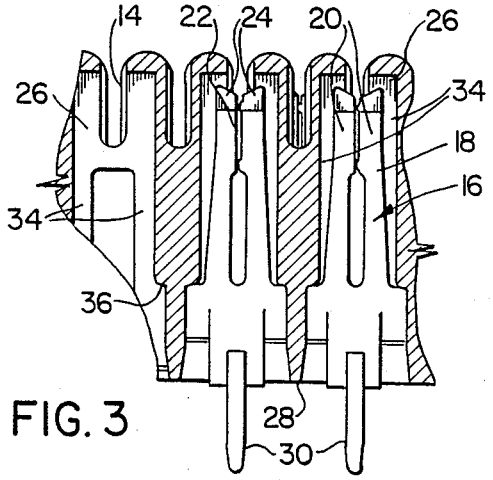
FIG. 3 is to the same scale as FIG. 2 and is a cross-sectional view through the connector taken along line III—III in FIG. 2.
Figure 4:
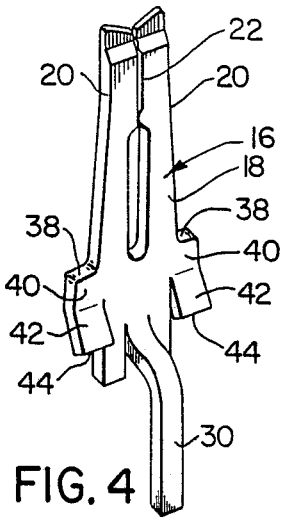
FIG. 4 is an isometric view of a contact member used in the connector of FIGS. 1 to 3.

As shown in FIGS. 2, 3 and 4, a plurality of terminal members 16 extend through the body, the terminal members each having a main longitudinally extending portion 18 which is bifurcated for substantially the whole of its length to provide two arms 20 located substantially side-by-side in the same plane. The arms 20 extend into the insulation displacement terminal positions at the slots 14, with the free ends of the arms, i.e. at one end of each terminal member, providing an insulation displacement terminal by defining a slot between the arms for acceptance of a conductor wire, the slot 22 being in alignment with a corresponding slot 14. The free ends of the two arms are inclined as at positions 24 in FIG. 3, to provide cutting edges for cutting insulation around conductor wires so as to enable the wires to be forced between the arms with the insulation locally removed to cause the wires to make electrical contact with the arms. Such insulation displacement terminals are well known in the art and will be described no further.

Figure 5:
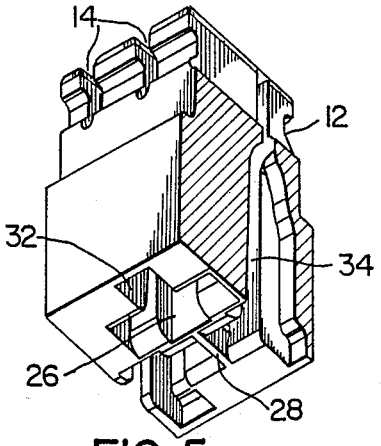
FIG. 5 is an isometric view on the underside of part of the connector of FIGS. 1 to 3.

To enable the insulation displacement terminals to be located as closely together as possible thereby minimizing the size of the connector, the terminal members are arranged in two staggered rows in the body. This is made possible by molding the body 12 with cavities 26 for acceptance of the contact members (FIG. 5), the cavities themselves lying in two staggered rows and overlapping so that the distance between the cavities in the same row is reduced to a minimum.

As shown particularly in FIG. 4, each terminal member 16 comprises not only the main portion 18 forming the arms 20, but also comprises a terminal pin 30 which extends from the other end of the main portion 18. As shown in FIG. 4, the terminal pin 30 lies in a plane displaced laterally from the plane of the main portion 18 and, with the pins assembled into the body 12, they are disposed in their two staggered rows with the terminal pins of each row displaced laterally of the plane of the body away from the other row (FIG. 2). Each cavity 26, at its entrance is locally widened as at position 32 to allow for the lateral displacement of a terminal pin 30 (FIG. 2) the base of which lies within the body.

Each cavity 26 has two longitudinally extending narrow sections 34. The arms 20 extend laterally into these narrow sections and have room for sideways movement to enable resilient flexing apart of the arms during attachment of a conductor wire between them as the insulation is being displaced. Each of the narrow sections 34 is provided with an abutment shoulder 36 (see FIG. 3) which faces away from the side edge formed with the slots 14. A terminal member is held in a desired position within a respective cavity 26 with the insulation displacement terminals of the arms 20 in the terminal positions, by engagement of two shoulders 38 of the terminal members with the shoulders 36 of the body. The shoulders 38 are provided one on each side of the main portion 18 and in the plane of the main portion, the shoulders being formed upon sideways extensions 40 of each terminal member. These sideways extensions 40 also provide a retaining means for holding the terminal member in its desired position with the shoulders 36 and 38 engaged. This retaining means comprises two projections 42, one at each side of the main portion and in alignment with the shoulders 38, the projections being formed as displaced parts of the extensions 40. Thus, as shown in FIG. 4, each projection 42 is inclined relative to the main portion 18 and extends away from the free ends of the arms 20 to a free end 44 of the projection. Each terminal member tapers slightly along extensions 40 towards the arms 20 to assist in insertion into the body 12.

As can be seen particularly from FIG. 3, the terminal members are inserted into their respective cavities 26, until the shoulders 38 engage shoulders 36. All edges of the terminal members are rounded to prevent jamming during insertion. Also, the terminal members are self-aligning. This is made possible by providing different angles of taper on the open part of the cavities from their openings to the shoulders 36 than on the members 16 at the sides of extensions 40. The inclination of the projections 42 allows for insertion of the terminal members by some resilient flexing of the projections and also by some diplacement of the plastics material of the body. Each projection lies within a narrow section 34 of its cavity and the free end of each projection embeds itself into the body material at one side of its narrow section upon the terminal member reaching its desired position. Hence, any effort to remove the terminal member from the body is prevented as the extensions 42 embed themselves more firmly into the body material thereby increasing resistance to removal.

Figure 6:
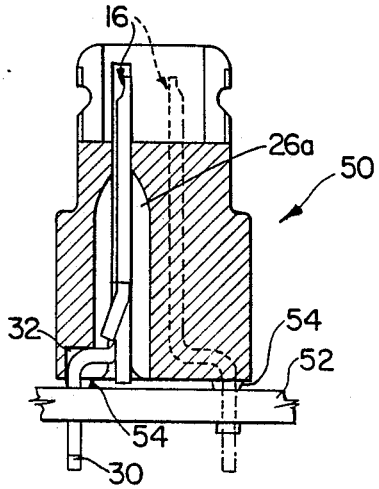
FIGS. 6 and 7 are views similar to FIGS. 3 and 4 of the connector mounted upon a printed circuit board to form an assembly.
Figure 7:
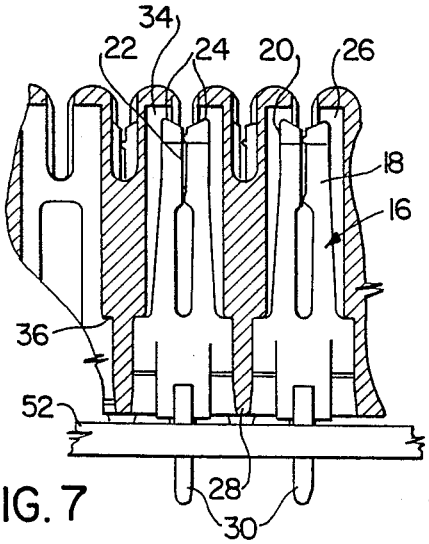

The insulation displacement connector 10 is suitable for use in assembly with a circuit member, i.e. a planar member carrying electrical pathways. Such a circuit member may comprise a printed circuit board or a resistor network which comprises a ceramic base and electrical pathways formed by thick film techniques. As shown in FIGS. 6 and 7, an assembly 50 comprises a printed circuit board 52 of conventional construction and the connector 10 of the first embodiment mounted upon the board with the terminal pins 30 soldered into pin receiving holes in the board. For this purpose, and as shown in FIGS. 1 and 2, the body 12 is formed with two molded mounting pins 54 which extend outwardly in the same direction as the terminal pins 30. These pins 54 are received within suitably positioned holes in the printed circuit board 52 for assisting in locating the connector 10 correctly in position prior to the soldering operation.

Figure 8:
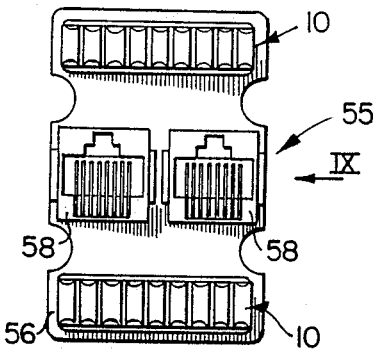
FIG. 8 is a plan view of two connectors and a printed circuit board according to a second embodiment.
Figure 9:
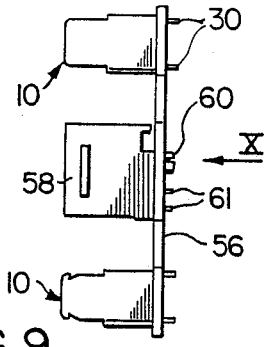
FIG. 9 is a view in the direction of arrow IX onto the assembly of FIG. 8.
Figure 10:
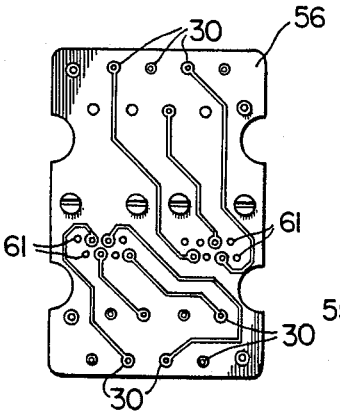
FIG. 10 is a view in the direction of arrow X in FIG. 9 onto the reverse side of the assembly.

In a second embodiment as shown in FIGS. 8, 9 and 10, two connectors 10 are used as parts of an assembly 55 of circuit and connector for use with a modular telephone jack. As can be seen from FIGS. 8 and 9, the connectors 10 are mounted upon a circuit board 56 of rectangular shape. Spaced between the connectors 10 and on the same side of the board are two modular telephone jacks 58. As shown partiularly by FIG. 9, the telephone jacks have molded bodies formed integrally with base projections 60 which extend through suitable holes in the printed circuit board for holding the jacks in position.

As shown in FIG. 10, the jacks have terminal pins 61 which are also soldered into holes in the board 56 and are connected by printed circuit electrical pathways 62 with certain of the terminal pins 30 of the connectors 10.

As may be realized, the printed circuit on board 56 has a design which depends on the end usage of the modular jacks 58. These particular jacks are used simply for telephonic purposes. However, printed circuit boards of other designs may be used in an assembly with the connectors 10 and the modular jacks 58, such designs possibly including the use of all eight of the terminal pins of the connectors 10. Such designs may render the assembly suitable for a dual function, i.e. for connection to a telephone or alternatively for connection to data processing equipment.

As may be seen from the second embodiment, the connector 10 of the first embodiment is useful when used in the assembly 55 which is assembled automatically by factor operation. Hence, in manufacture of the assembly, the tedious and intricate wiring steps involved in connecting the modular jack to another connector are avoided.

Figure 11:
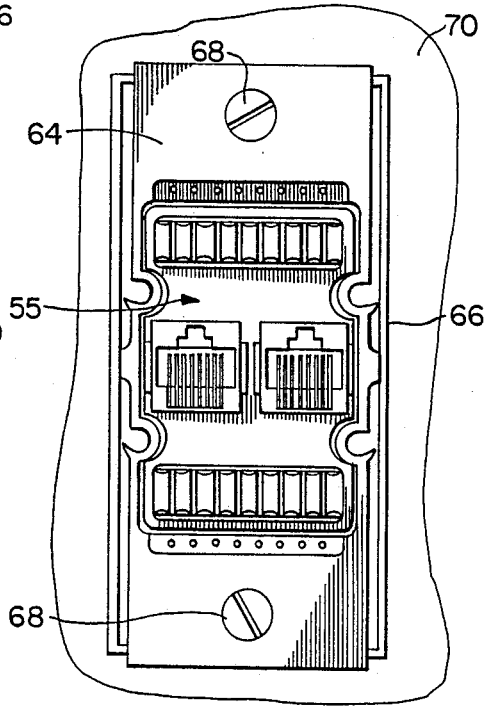
FIG. 11 is a plan view of the assembly of FIGS. 8 to 10 as part of a wall fitting.

The assembly 55 is for use in a housing 64 which is of suitable size for fitting into a conventional wall mounted domestic electrical box 66 by screws 68 (FIG. 11) the box 66 mounted within a cavity in a wall 70. After incoming wiring (not shown) is connected to appropriate insulation displacement terminals provided by arms 20 of the two connectors 10, the assembly is ready for use either with a telephone or, for instance, with a data processing terminal as the case may be. A suitable cover (not shown) is placed over the housing 64 and assembly 55 with access apertures to enable plugs to be inserted into either of the jacks 58.

What is claimed is:

1. An insulation displacement connector comprising:

a planar dielectric body having insulation displacement terminal positions extending along one edge region of the body;

a plurality of elongate terminal members, each having a longitudinal direction and having:

(a) a substantially planar main portion comprising, in series in said longitudinal direction, an insulation displacement terminal slot extending lengthwise of the main portion from one end of the member, at least one shoulder in the plane of the main portion, the shoulder facing towards said one end of the member, and at least one retaining projection for retaining the member within the body, the projection being inclined relative to the main portion about a bend line transversely to said longitudinal direction and extending to a free end facing longitudinally away from the shoulder; and (b) a terminal pin extending from the main portion about bend lines transverse to said longitudinal direction to lie in a plane substantially parallel to the main portion;

the terminal members inserted into the body from another and opposite edge region of the body with the shoulder of each terminal member engaging an abutment within the body to prevent further movement into the body and with the free end of the retaining projection embedded into the body to resist the insertion force of a wire into the insulation displacement terminal in a direction longitudinally of the terminal member, the terminal members being disposed in two rows within the body with the main portions in each row being coplanar with the body and with the insulation displacement terminal slots disposed in the terminal positions, the terminal pins of each row extending from the body and being displaced laterally of the plane of the body away from the terminal pins of the other row.

2. A connector according to claim 1 wherein the dielectric body is a single molded unitary structure.

3. A connector according to claim 1 wherein each terminal member has a shoulder at each side and in the plane of the main portion, each shoulder engaging an abutment of the body and two retaining projections are provided, one at each side of the main portion of the terminal member.

4. A connector according to claim 3 wherein one shoulder is associated with each projection and each projection is in alignment with each shoulder along the length of the terminal member.

5. An assembly of insulation displacement connector and a circuit member:

the insulation displacement connector comprising:

a planar dielectric body having insulation displacement terminal positions extending along one edge region of the body;

a plurality of elongate terminal members, each having a longitudinal direction and having:

(a) a substantially planar main portion comprising, in-series in said longitudinal direction, an insulation displacement terminal slot extending lengthwise of the main portion from one end of the member, at least one shoulder in the plane of the main portion, the shoulder facing towards said one end of the member, and at least one retaining projection for retaining the member within the body, the projection being inclined relative to the main portion about a bend line transversely to said longitudinal direction and extending to a free end facing longitudinally away from the shoulder; and (b) a terminal pin extending from the main portion about bend lines transverse to said longitudinal direction to lie in a plane substantially parallel to the main portion;

the terminal members inserted into the body from another and opposite edge region of the body with the shoulder of each terminal member engaging an abutment within the body to prevent further movement into the body and with the free end of the retaining projection embedded into the body to resist the insertion force of a wire into the insulation displacement terminal in a direction longitudinally of the terminal member, the terminal members being disposed in two rows within the body with the main portions in each row being coplanar with the body and with the insulation displacement terminal slots disposed in the terminal positions, the terminal pins of each row extending from the body and being displaced laterally of the plane of the body away from the terminal pins of the other row; and the circuit member comprising a support element for electrical pathways extending to surfaces of pin receiving holes formed in the support element, and the connector mounted upon the circuit member with the terminal pins received within the holes and electrically connected to the electrical pathways.

6. An assembly according to claim 5 wherein the dielectric body is a single molded unitary structure.

7. An assembly according to claim 5 wherein each terminal member has a shoulder at each side and in the plane of the main portion, each shoulder engaging an abutment of the body and two retaining projections are provided, one at each side of the main portion of the terminal member.

* * * * *